US007703510B2

(12) United States Patent
Xu

(10) Patent No.: US 7,703,510 B2
(45) Date of Patent: Apr. 27, 2010

(54) INTERVENTIONLESS MULTI-POSITION FRAC TOOL

(75) Inventor: Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 274 days.

(21) Appl. No.: 11/895,714

(22) Filed: Aug. 27, 2007

(65) Prior Publication Data

US 2009/0056934 A1 Mar. 5, 2009

(51) Int. Cl.
*E21B 43/26* (2006.01)

(52) U.S. Cl. ..... 166/177.5; 166/194; 166/318; 166/308.1

(58) Field of Classification Search ..... 166/298, 166/373, 308.1, 177.5, 318, 194, 244.1
See application file for complete search history.

(56) References Cited

U.S. PATENT DOCUMENTS

| | | | | |
|---|---|---|---|---|
| 4,718,494 | A * | 1/1988 | Meek | 166/373 |
| 4,967,841 | A | 11/1990 | Murray | |
| 5,325,921 | A | 7/1994 | Johnson et al. | |
| 5,499,678 | A | 3/1996 | Surjaatmadja et al. | |
| 5,722,490 | A | 3/1998 | Ebinger | |
| 6,832,654 | B2 | 12/2004 | Ravensbergen et al. | |
| 7,078,370 | B2 | 7/2006 | Crews | |

OTHER PUBLICATIONS

Henry Restarick, Horizontal Completion Options in Reservoirs With Sand Problems, Mar. 11, 1995, pp. 545-560, SPE 29831, Society of Petroleum Engineers, Inc., U.S.A.

E. Paul Bercegeay, A One-Trip Gravel Packing System, Feb. 7, 1974, pp. 1-12, SPE 4771, American Institute of Mining, Metallurgical, and Petroleum Engineers, Inc., U.S.A.

E. Harold Vickery, Application of One-Trip Multi-Zone Gravel Pack to Maximize Completion Efficiency, Oct. 12, 2000, pp. 1-10, SPE 64469, Society of Petroleum Engineers Inc., U.S.A.

Stephen P. Mathis, Sand Management: A Review of Approaches and Concerns, May 13, 2003, pp. 1-7, SPE 82240, Society of Petroleum Engineers Inc., U.S.A.

* cited by examiner

*Primary Examiner*—Jennifer H Gay
*Assistant Examiner*—Brad Harcourt
(74) *Attorney, Agent, or Firm*—Greenberg Traurig LLP; Anthony F. Matheny

(57) ABSTRACT

Fracturing tools for use in oil and gas wells are disclosed. The fracturing tools have a run-in position and two operational positions. A sleeve disposed in the bore of the fracturing tool comprises a sleeve port alignable with a first port in the housing of the frac tool, i.e., the first operational position, during fracturing operations. A second port having a restriction member is disposed in the housing and is closed by the sleeve during fracturing operations. After fracturing operations are completed, a return member in the frac tool moves the sleeve from the first operational position to a second operational position for production operations. In this second operational position, the first port is closed and the sleeve port is aligned with the second port. Movement of the sleeve from the first operational position to the second operational position is performed without the need for an additional well intervention step.

19 Claims, 1 Drawing Sheet

INTERVENTIONLESS MULTI-POSITION FRAC TOOL

BACKGROUND

1. Field of Invention

The invention is directed to fracturing tools for use in oil and gas wells, and in particular, to fracturing tools having a sleeve capable of being moved from a first operational position to a second operational position so that the fracturing tool can fracturing the formation in the first operational position and then be moved, without well intervention, to the second operational position to produce return fluids from the well.

2. Description of Art

Fracturing or "frac" systems or tools are used in oil and gas wells for completing and increasing the production rate from the well. In deviated well bores, particularly those having longer lengths, fracturing fluids can be expected to be introduced into the linear, or horizontal, end portion of the well to frac the production zone to open up production fissures and pores therethrough. For example, hydraulic fracturing is a method of using pump rate and hydraulic pressure created by fracturing fluids to fracture or crack a subterranean formation.

In addition to cracking the formation, high permeability proppant, as compared to the permeability of the formation can be pumped into the fracture to prop open the cracks caused by a first hydraulic fracturing step. For purposes of this disclosure, the proppant is included in the definition of "fracturing fluids" and as part of well fracturing operations. When the applied pump rates and pressures are reduced or removed from the formation, the crack or fracture cannot close or heal completely because the high permeability proppant keeps the crack open. The propped crack or fracture provides a high permeability path connecting the producing wellbore to a larger formation area to enhance the production of hydrocarbons.

One result of fracturing a well is that the return fluids, e.g., oil, gas, water, that are sought to be removed from the well are mixed with sand and other debris broken loose in the formation. As a result, after fracturing, an intervention step is performed to reorient a downhole tool such as a frac tool so that the return fluids are passed through a screen or other device to filter out the sand and debris. This intervention step usually involves dropping a ball or other plug element into the well to isolate a portion of the well or to actuate the frac tool to move an actuator to open a fluid flow path through the screen and closes a fluid flow path through which the fracturing fluid was previously injected into the well or well formation.

SUMMARY OF INVENTION

After being run-in to the well in a non-operational "run-in" position and moved to a first operational position, the frac tools disclosed herein are capable of orienting themselves into a second operational position without the need for an intervention step to move the frac tools from a first operational position to the second operational position. The term "operational position," means that the frac tool is oriented within a well in such a manner so that well completion, well production, or other methods can be performed to the well by the frac tool. In other words, "operational position," means that the frac tool is oriented within in a well so that the frac tool can perform the function(s) for which it was designed.

Broadly, the frac tools include a housing having a bore defined by an inner wall surface. The housing includes a series of ports, e.g., at least two ports, one of which may include a fluid flow control member such as a screen or filter used to prevent debris from entering the frac tool or a device for controlling the rate of fluid flow through the port. This "fluid flow controlled" port is disposed above the other port lacking the fluid flow control member.

A sleeve is in sliding engagement with the inner wall surface of the housing and includes an actuator and a sleeve port in the side wall of the sleeve. A retaining member such as a shear screw or collet operatively associated with the inner diameter of the frac tool maintains the sleeve in the run-in position until actuated. While in the run-in position, both of the ports in the housing are closed.

After the frac tool is disposed within the well at the desired location, an actuator, such as a ball seat, can be activated to release the sleeve from the retaining member and to force the sleeve into the first operational position so that the sleeve port is aligned with a first port in the housing of the frac tool. Meanwhile, the second port in the housing remains closed. This first port in the housing does not include a fluid flow restriction member so that fracturing fluid can be injected through the first port into the well or well formation without any fluid flow impedance. As a result of the alignment of the first port with the sleeve port, fracturing fluid is allowed to flow from the bore of the frac tool and into the well to fracturing the well or formation.

After the well is fraced, the flow pressure of the fracturing fluid is reduced. As a result, a return member, such as a spring, forces the sleeve to move from the first operational position to the second operational position so that the sleeve port is now aligned with the second port in the housing. Meanwhile the first port in the housing is now closed. As mentioned above, this second port in the housing can include a fluid flow control member. As a result of the alignment of the sleeve port with this second port, return fluids from the well or formation are allowed to flow into the bore of the housing and up to the surface of the well. In so doing, at least some of the debris in the return fluids is prevented by the screen from entering the bore of the housing and/or the return fluid flow rate is controlled.

In one embodiment, a frac tool having a run-in position, a first operational position, and a second operational position is disclosed. The frac tool may comprise a housing having an inner wall surface defining a bore, a first port, and a second port disposed above the first port; a sleeve in sliding engagement with the inner wall surface of the housing, the sleeve having a sleeve port and an actuator for moving the sleeve from the run-in position to the first operational position; and a return member in sliding engagement with the inner wall surface and operatively associated with the sleeve, the return member having a biased member, the biased member being energized when the frac tool is in the first operational position and the biased member not being energized when the frac tool is in the second operational position, wherein the sleeve port closes the first and second ports in the housing when the frac tool is in the run-in position, the sleeve port is aligned with the first port in the housing and the second port is closed by the sleeve when the frac tool is in the first operational position, and the sleeve port is aligned with the second port in the housing and the first port is closed by the sleeve when the frac tool is in the second operational position.

A further feature of the frac tool is that the actuator may comprise a seat disposed in a sleeve bore, the seat being actuatable by a plug element so that the sleeve can be moved from the run-in position to the first operational position by fluid pressure forcing the plug element into the seat. Another feature of the frac tool is that the seat may comprise a ball seat and the plug element may comprise a ball. An additional feature of the frac tool is that the inner wall surface may include a shoulder operatively associated with the biased member and a stop shoulder operatively associated with the return member. Still another feature of the frac tool is that the return member may comprise a return sleeve, the return sleeve having a head portion, a stem portion, and return member bore longitudinally disposed therethrough. A further feature of the frac tool is that the head portion, stem portion, inner wall surface, and shoulder may form a chamber in which the biased member is disposed. Another feature of the frac tool is that the biased member may comprise a coiled spring. An additional feature of the frac tool is that the sleeve may include a releasable retaining member for maintaining the sleeve in the run-in position. Still another feature of the frac tool is that the releasable retaining member may comprise a flange disposed on the sleeve, the flange be operatively associated with a recess disposed along the inner wall surface of the housing. A further feature of the frac tool is that the return member may be disposed below the sleeve and includes an engagement surface for engaging the sleeve in the first and second operational positions.

In another embodiment, a frac tool has a run-in position, a first operational position, and a second operational position and comprises a housing have a bore, an inner wall surface, the inner wall surface defining the bore, an outer wall surface, a first port and a second port, each of the first port and the second port providing fluid communication with the bore through the inner wall surface and the outer wall surface, the first port being disposed below the second port and the second port having a screen disposed therein; a sleeve in sliding engagement with the inner wall surface of the housing, the sleeve having a sleeve port and a seat disposed within a sleeve bore, the seat having a seat engagement surface for receiving a plug element to restrict fluid flow through the sleeve bore so that the sleeve is movable from the run-in position to the first operational position by fluid pressure forcing the plug element into the seat; and a return member in sliding engagement with the inner wall surface and operatively associated with the sleeve, the return member having a biased member, the biased member being energized by movement of the sleeve from the run-in position to the first operational position, wherein the sleeve port closes the first and second ports in the housing when the frac tool is in the run-in position, the sleeve port is aligned with the first port in the housing and the second port is closed by the sleeve when the frac tool is in the first operational position, and the sleeve port is aligned with the second port in the housing and the first port is closed by the sleeve when the frac tool is in the second operational position.

A further feature of the frac tool is that the return member may be disposed below the sleeve and includes an engagement surface for engaging the sleeve in the first and second operational positions. Another feature of the frac tool is that the inner wall surface may include a shoulder operatively associated with the biased member and a stop shoulder operatively associated with the return member and the return member comprises a return sleeve, the return sleeve having a head portion, a stem portion, and return member bore longitudinally disposed therethrough. An additional feature of the frac tool is that the head portion, stem portion, inner wall surface, and shoulder may form a chamber in which the biased member is disposed. Still another feature of the frac tool is that the biased member comprises an elastic element. A further feature of the frac tool is that the elastic element comprises a coiled spring.

In an additional embodiment, a method of fracturing and producing fluids from a well is disclosed. The method may comprise the steps of: (a) disposing a frac tool in a string, the frac tool comprising a housing have a bore defined by an inner wall surface, an outer wall surface, a first port and a second port, each of the first port and the second port providing fluid communication with the bore through the inner wall surface and the outer wall surface, the first port being disposed below the second port, a sleeve in sliding engagement with the inner wall surface of the housing, the sleeve having a sleeve port, a run-in position, a first operational position, and a second operational position, wherein the sleeve port is aligned with the first port in the first operational position and the sleeve port is aligned with the second port in the second operational position, and a return member operatively associated with the sleeve and in sliding engagement with the inner wall surface of the housing; (b) lowering the string into the well; (c) moving the sleeve from the run-in position to the first operational position thereby energizing the return member; (d) fracturing the well in the first operational position by pumping a fracturing fluid through the bore, through the sleeve port, through the first port, and into the well; (e) reducing the flow of the fracturing fluid through the bore, through the sleeve port, and through the first port; (f) moving the sleeve from the first operational position to the second operational position by releasing energy stored in the return member to move the sleeve from the first operational position to the second operational position; and (g) producing fluids from the well by flowing fluids from the well, through the second port, through the sleeve port, and into the bore of the housing.

A further feature of the method is that the sleeve may be moved from the run-in position to the first operational position by disposing a plug element on a seat disposed within a sleeve bore of the sleeve so that fluid pressure builds up above the plug element to force the sleeve from the run-in position to the first operational position. Another feature of the method is that the return member may be energized by compressing an elastic member. An additional feature of the method is that the return member may be energized by the return member being moved from a static position to an energized position by the sleeve engaging the return member and forcing the return member into a shoulder disposed along the inner wall surface of the housing.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
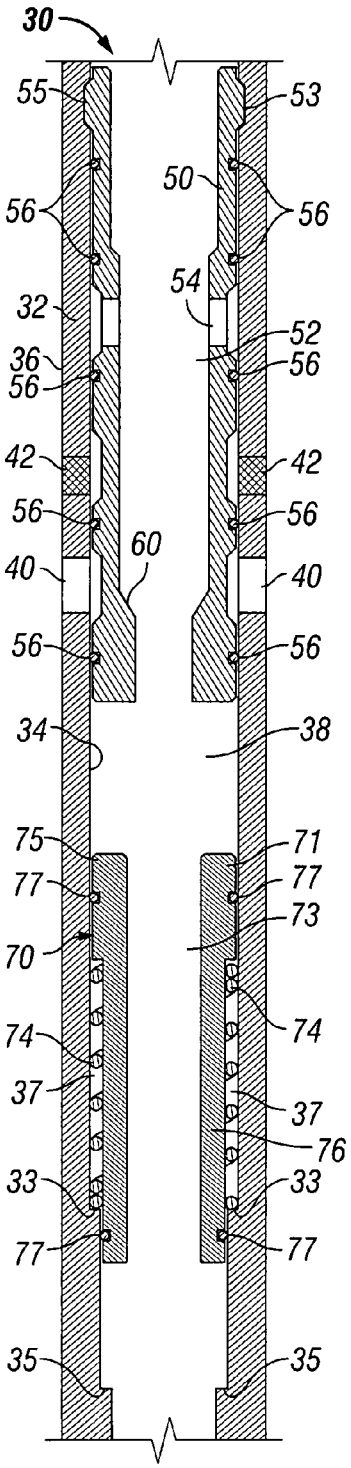
FIG. 1 is a cross-sectional view of one specific embodiment of the fracturing tool disclosed herein shown in the run-in position.
Figure 2:
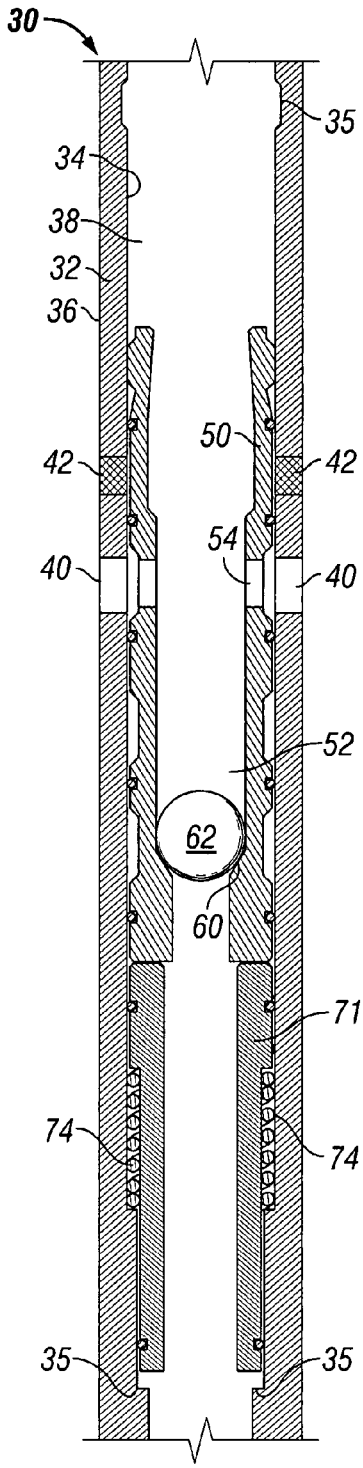
FIG. 2 is a partial cross-sectional view of the multi-position fracturing tool of FIG. 1 shown in the first operational, or fracturing, position.
Figure 3:
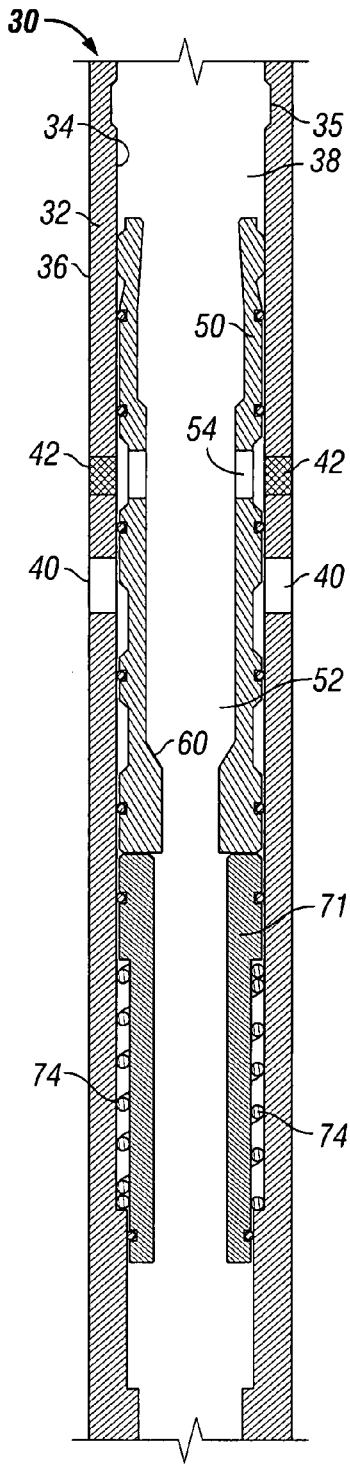
FIG. 3 is a cross-sectional view of the multi-position fracturing tool of FIG. 1 shown in the second operational, or producing, position.

Referring now to FIGS. 1-3, fracturing or frac tool 30 includes outer housing 32 having inner wall surface 34, outer wall surface 36, bore 38, first or fracturing port, 40, and second or production port 42. Second port 42 may include a fluid flow control member or device shown as screen 43 that allows liquids to flow through second port 42, but prevents certain sized particulate matter from flowing through second port 42. Second port 42 may also include a second fluid flow control member such as a choke (not shown), that is capable of controlling the pressure drop and flow rate through second port 42. In one particular embodiment, second port 42 includes screen 43 and a choke.

Sleeve 50 is in sliding engagement with inner wall surface 34. Sleeve 50 includes bore 52 and retaining member 53 shown as a flange 55 that is disposed within recess 35 in inner wall surface 35. Sleeve 50 also includes sleeve port 54 and an actuator for moving sleeve 50 from the run-in position (FIG. 1) to the first operational position (FIG. 2). The actuator may be any device or method known to persons of ordinary skill in the art. As shown in FIGS. 1-3, the actuator is a seat such as ball seat 60 capable of receiving plug element such as ball 62. Although FIGS. 1-3 show ball seat 60 and ball 62, it is to be understood that the seat is not required to be a ball seat and the plug element is not required to a ball. Instead, the seat can have any other shape desired or necessary for receiving a reciprocally shaped plug element.

Sleeve 50 includes dynamic seals 56 (numbered only in FIG. 1) to assist sleeve 50 in sliding along inner wall surface 34 and to reduce the likelihood of leaks between inner wall surface 34 and the outer wall surface of sleeve 50.

Also disposed along inner wall surface 34 is return member 70. Return member 70 comprises a return sleeve 71 having bore 73 and biased member 74. Although biased member 74 is shown as an elastic member such as a spring in FIGS. 1-3, it is to be understood that biased member 74 can be another elastic device that is capable of being energized to exert a force upward or against the flow of fluid against sleeve 50 when sleeve 50 is in the first operational position (FIG. 2). Suitable elastic members for utilization as biased member 74 include belleville springs (also known as belleville washers), capillary springs, and deformable elastomers and polymers.

Return sleeve 71 is in sliding engagement with inner wall surface 34. As shown in FIGS. 1-3, inner wall surface 34 includes shoulders 33 and 35 and return sleeve 71 comprises a head portion 75 and a stem portion 76. Dynamic seals 77 (numbered only in FIG. 1) disposed on return sleeve 71 assist return sleeve 71 in sliding along inner wall surface 34 and to reduce the likelihood of leaks between inner wall surface 34 and the outer wall surface of return sleeve 71.

Head portion 75 and shoulder 33 form chamber 37 in which biased member 74 is disposed. Shoulder 35 provides a stop to prevent sliding of return sleeve 71 at a predetermined location along inner wall surface 34.

Biased member 74 is disposed within chamber 37 and on shoulder 33 so that biased member 74 can urge head portion 75 and, thus, return sleeve 71 upward.

As illustrated in FIG. 2, ball 62 engages ball seat 60 to restrict fluid flow through bore 52. Fluid pressure, such as by pumping fracturing fluid (not shown) down through bore 38, is exerted onto ball 62 causing retaining member 53 to release from inner wall surface 34 so that sleeve 50 is forced downward into return member 70. Sleeve 50 continues to be forced downward, energizing biased member 74, until return sleeve 71 engages shoulder 35. In this position, sleeve port 54 is aligned with first port 40 of housing 32 and, thus, frac tool 30 is in the first operational position as shown in FIG. 2. Accordingly, fracturing fluid can be pumped from bore 38, through sleeve port 54, through first port 40, and into well or well formation to fracture the formation.

As shown in FIG. 3, after sufficient fracturing fluid is injected into the well or open hole formation, ball 62 is removed from ball seat 60 through any method known to persons skilled in the art. For example, ball 62 may be removed from ball seat 60 by increasing the fluid pressure of the fracturing fluid being pumped downward through bore 38 until ball 62 is forced through ball seat 60 so that it can fall to the bottom of the well. Alternatively, ball 62 may be removed from ball seat 60 by decreasing the fluid pressure of the fracturing fluid being pumped downward through bore 38 so that ball can float back to the surface of the well.

Reduction of the fluid pressure of the fracturing fluid, either after forcing ball 62 through ball seat 60, or to allow ball 62 to float to the surface of the well, allows energized biased member 74 to overcome the downward force of the fluid being, or previously being, pumped downward through bore 38. When the upward force of biased member 74 overcomes the downward force of the fluid being, or previously being, pumped downward through bore 38, return member 70 begins to move upward and, thus, forces sleeve 50 upward from the first operational position (FIG. 2) to the second operational position (FIG. 3). In this position, sleeve port 54 is aligned with second port 42 of housing 32 and, thus, frac tool 30 is in the second operational position as shown in FIG. 3. Accordingly, return fluids, such as oil, gas, and water, are permitted to flow from the well or well formation and into bore 38 so that the return fluids can be collected at the surface of the well.

In operation, frac tool 30 is disposed on a tubing or casing string through attachment members (not shown) disposed at the upper and lower ends of housing 32. The string is then lowered into the well to the desired location. During this run-in step, sleeve 50 and, thus frac tool 30 is in the run-in position (FIG. 1) so that first and second ports 40, 42 are closed.

Bore 52 is restricted and sleeve 50 is moved from the first operational position to the second operational position. In one specific embodiment, bore 52 is restricted by dropping a plug element such as ball 60 into bore 38 and landing the plug element on a seat. Fracturing fluid is pumped down bore 38 to release sleeve 50 and force sleeve 50 downward. Sleeve 50 engages return member 70 and forces return member 70 downward until return member 70 engages a stop disposed along inner wall surface 34, e.g., stop shoulder 35. In so doing, return member 70 becomes energized.

When return member 70 is energized, sleeve 50 and, thus, frac tool 30, is in the first operational position (FIG. 2) such that sleeve port 54 is aligned with first port 40 of housing 32. Fracturing fluid, therefore, is allowed to flow from bore 38 into well or well formation to fracturing the formation. After an amount of time as passed to fracture the formation as desired or necessary to stimulate hydrocarbon production from the well, fracturing fluid is no longer pumped downward through bore 38. In one embodiment, bore 52 is completely opened, i.e., no longer restricted, prior to or during movement of sleeve from the first operational position (FIG. 2) to the second operational position (FIG. 3). Due to the reduction in fluid pressure acting to force sleeve 50 into return member 70, the energized return member 70 moves sleeve 50 upward from the first operational position (FIG. 2) to the second operational position (FIG. 3). As a result, sleeve port 54 is now aligned with second port 42 in housing 32 and first port 40 is closed off.

Once oriented in the second operational position (FIG. 3), return fluids are allowed to flow from the well or well formation through second port 42 and into bore 38 so that the return fluids can flow to the surface of the well for collection.

As will be recognized by persons of ordinary skill in the art, movement of frac tool 30 from the first operational position (FIG. 2) to the second operational position (FIG. 3) did not require any well intervention using another tool or device. All that was required was the reduction of fluid pressure forcing sleeve 50 into return member 70 either to facilitate both removal of the restriction in bore 52 and movement of sleeve 50 from the first operational position (FIG. 2) to the second operational position (FIG. 3), or to facilitate movement of sleeve 50 from the first operational position (FIG. 2) to the second operational position (FIG. 3) after the restriction in bore 52 has been removed by other non-intervention means, e.g., forcing ball 62 through ball seat 60. In another embodiment, restriction of bore 52 is not required during fracturing operations, i.e., when frac tool 30 is in the first operational position (FIG. 2). In an additional embodiment, bore 52 can remain restricted during production operations, i.e., when frac tool 30 is in the second operational position.

In the embodiments discussed herein with respect FIGS. 1-3, upward, toward the surface of the well (not shown), is toward the top of FIGS. 1-3, and downward or downhole (the direction going away from the surface of the well) is toward the bottom of FIGS. 1-3. In other words, "upward" and "downward" are used with respect to FIGS. 1-3 as describing the vertical orientation illustrated in FIGS. 1-3. However, it is to be understood that frac tool 30 may be disposed within a horizontal or other deviated well so that "upward" and "downward" are not oriented vertically.

It is to be understood that the invention is not limited to the exact details of construction, operation, exact materials, or embodiments shown and described, as modifications and equivalents will be apparent to one skilled in the art. For example, return member may include a belleville spring (also known as belleville washers) or a deformable elastomer or rubberized element. Moreover, return member may be an actuator energized by hydraulic pressure, hydrostatic pressure or electrical power such as from battery packs having electrical timers. Additionally, the actuator for moving the sleeve from the first operational position to the second operational position may be a piston that is actuated using hydrostatic or other pressure. Accordingly, the invention is therefore to be limited only by the scope of the appended claims.

What is claimed is:

1. A frac tool having a run-in position, a first operational position, and a second operational position, the frac tool comprising:

a housing having an inner wall surface defining a bore, a first port, and a second port disposed above the first port;

a sleeve in sliding engagement with the inner wall surface of the housing, the sleeve having a sleeve port and an actuator for moving the sleeve from the run-in position to the first operational position, the actuator comprising a seat disposed in a sleeve bore, the seat being actuatable by a plug element so that the sleeve can be moved from the run-in position to the first operational position by fluid pressure forcing the plug element into the seat; and a return member in sliding engagement with the inner wall surface and operatively associated with the sleeve, the return member having a biased member, the biased member being energized when the frac tool is in the first operational position and the biased member not being energized when the frac tool is in the second operational position, wherein the sleeve port closes the first and second ports in the housing when the frac tool is in the run-in position, the sleeve port is aligned with the first port in the housing and the second port is closed by the sleeve when the frac tool is in the first operational position, and the sleeve port is aligned with the second port in the housing and the first port is closed by the sleeve when the frac tool is in the second operational position.

2. The frac tool of claim 1, wherein the seat comprises a ball seat and the plug element comprises a ball.

3. The frac tool of claim 1, wherein the inner wall surface includes a shoulder operatively associated with the biased member and a stop shoulder operatively associated with the return member.

4. The frac tool of claim 3, wherein the return member comprises a return sleeve, the return sleeve having a head portion, a stem portion, and return member bore longitudinally disposed therethrough.

5. The frac tool of claim 4, wherein the head portion, stem portion, inner wall surface, and shoulder form a chamber in which the biased member is disposed.

6. The frac tool of claim 5, wherein the biased member comprises a coiled spring.

7. The frac tool of claim 1, wherein the sleeve includes a releasable retaining member for maintaining the sleeve in the run-in position.

8. The frac tool of claim 7, wherein the releasable retaining member comprises a flange disposed on the sleeve, the flange be operatively associated with a recess disposed along the inner wall surface of the housing.

9. The frac tool of claim 1, wherein the return member is disposed below the sleeve and includes an engagement surface for engaging the sleeve in the first and second operational positions.

10. A frac tool having a run-in position, a first operational position, and a second operational position, the frac tool comprising:

a housing have a bore, an inner wall surface, the inner wall surface defining the bore, an outer wall surface, a first port and a second port, each of the first port and the second port providing fluid communication with the bore through the inner wall surface and the outer wall surface, the first port being disposed below the second port and the second port having a screen disposed therein;

a sleeve in sliding engagement with the inner wall surface of the housing, the sleeve having a sleeve port and a seat disposed within a sleeve bore, the seat having a seat engagement surface for receiving a plug element to restrict fluid flow through the sleeve bore so that the sleeve is movable from the run-in position to the first operational position by fluid pressure forcing the plug element into the seat; and a return member in sliding engagement with the inner wall surface and operatively associated with the sleeve, the return member having a biased member, the biased member being energized by movement of the sleeve from the run-in position to the first operational position, wherein the sleeve port closes the first and second ports in the housing when the frac tool is in the run-in position, the sleeve port is aligned with the first port in the housing and the second port is closed by the sleeve when the frac tool is in the first operational position, and the sleeve port is aligned with the second port in the housing and the first port is closed by the sleeve when the frac tool is in the second operational position.

11. The frac tool of claim 10, wherein the return member is disposed below the sleeve and includes an engagement surface for engaging the sleeve in the first and second operational positions.

12. The frac tool of claim 10, wherein the inner wall surface includes a shoulder operatively associated with the biased member and a stop shoulder operatively associated with the return member and the return member comprises a return sleeve, the return sleeve having a head portion, a stem portion, and return member bore longitudinally disposed therethrough.

13. The frac tool of claim 12, wherein the head portion, stem portion, inner wall surface, and shoulder form a chamber in which the biased member is disposed.

14. The frac tool of claim 13, wherein the biased member is an elastic element.

15. The frac tool of claim 14, wherein the elastic element is a coiled spring.

16. A method of fracturing and producing fluids from a well, the method comprising the steps of:

(a) disposing a frac tool in a string, the frac tool comprising a housing have a bore defined by an inner wall surface, an outer wall surface, a first port and a second port, each of the first port and the second port providing fluid communication with the bore through the inner wall surface and the outer wall surface, the first port being disposed below the second port, a sleeve in sliding engagement with the inner wall surface of the housing, the sleeve having a sleeve port, a run-in position, a first operational position, and a second operational position, wherein the sleeve port is aligned with the first port in the first operational position and the sleeve port is aligned with the second port in the second operational position, and a return member operatively associated with the sleeve and in sliding engagement with the inner wall surface of the housing;

(b) lowering the string into the well;

(c) moving the sleeve from the run-in position to the first operational position thereby energizing the return member;

(d) fracturing the well in the first operational position by pumping a fracturing fluid through the bore, through the sleeve port, through the first port, and into the well;

(e) reducing the flow of the fracturing fluid through the bore, through the sleeve port, and through the first port;

(f) moving the sleeve from the first operational position to the second operational position by releasing energy stored in the return member to move the sleeve from the first operational position to the second operational position; and (g) producing fluids from the well by flowing fluids from the well, through the second port, through the sleeve port, and into the bore of the housing.

17. The method of claim 16, wherein the sleeve is moved from the run-in position to the first operational position by disposing a plug element on a seat disposed within a sleeve bore of the sleeve so that fluid pressure builds up above the plug element to force the sleeve from the run-in position to the first operational position.

18. The method of claim 16, wherein the return member is energized by compressing an elastic member.

19. The method of claim 16, wherein the return member is energized by the return member being moved from a static position to an energized position by the sleeve engaging the return member and forcing the return member into a shoulder disposed along the inner wall surface of the housing.

* * * * *